US007963205B1

(12) United States Patent
Brooks

(10) Patent No.: US 7,963,205 B1
(45) Date of Patent: Jun. 21, 2011

(54) TRI-MOUNT CRADLE SYSTEM

(75) Inventor: Adam S. Brooks, Sellersburg, IN (US)

(73) Assignee: Kiesler Police Supply, Inc., Jeffersonville, IN (US)

( * ) Notice: Subject to any disclaimer, the term of this patent is extended or adjusted under 35 U.S.C. 154(b) by 330 days.

(21) Appl. No.: 12/056,449

(22) Filed: Mar. 27, 2008

(51) Int. Cl.
*F41A 23/04* (2006.01)

(52) U.S. Cl. ..... 89/37.03; 89/37.07

(58) Field of Classification Search ..... 89/37.01, 89/37.03, 37.04, 37.07; 42/94; D22/108; 248/671

See application file for complete search history.

(56) References Cited

U.S. PATENT DOCUMENTS 4,417,499 A 11/1983 Grosser et al.
D275,304 S * 8/1984 Bacon ..... D22/108
4,819,359 A * 4/1989 Bassett ..... 42/94
5,791,499 A * 8/1998 Zebbedies ..... 211/64
6,283,428 B1 9/2001 Maples et al.
6,675,694 B1 1/2004 Liebig
6,920,713 B1 * 7/2005 Love ..... 42/94
6,931,778 B1 8/2005 Nelson et al.
7,258,055 B1 * 8/2007 Javorsky ..... 89/37.01
7,543,524 B1 * 6/2009 Javorsky ..... 89/37.01
7,610,842 B1 * 11/2009 Brooks ..... 89/37.03
2007/0051235 A1 * 3/2007 Hawkes et al. ..... 89/37.04
2008/0092732 A1 * 4/2008 Becker et al. ..... 89/37.03

* cited by examiner

*Primary Examiner* — Bret Hayes
(74) *Attorney, Agent, or Firm* — Alexander P. Brackett; Middleton Reutlinger

(57) ABSTRACT

A weapon mounting system for securing a weapon such as a machine gun to a platform comprises a cradle assembly including a pair of opposed front and rear flanges having apertures therein for engaging a retaining pin to secure a weapon thereto. The cradle assembly of the present invention is formed of a single piece of high strength material, for example aluminum stainless steel or titanium. The cradle assembly further includes a pair of pintle flanges to engage a pintle, thereby enabling rotation of cradle and concomitant weapon around two axes.

24 Claims, 9 Drawing Sheets

TRI-MOUNT CRADLE SYSTEM

BACKGROUND OF THE INVENTION

1. Field of the Invention

The present invention relates generally to a system for securing a weapon to a platform and more particularly to a weapon cradle system having a cradle that is readily secured to a plurality of machine gun or rifles having a pair of spaced attachment points. The invention further comprises a reinforced cradle that is capable of being rotated around two axes when secured to a pintle and concomitant weapon mount.

2. Description of the Related Art

Weapons suited for use in military operations often have a size and weight that prohibits them from being employed by a user because they cannot be accurately aimed or stabilized without being mounted to a platform of some type, for example the bed of a truck or jeep. In order to obviate this difficulty, mounting devices of various designs have been employed in an attempt provide a mechanism for reliably securing the weapon to a platform, while simultaneously making it easy to both aim and remove for cleaning.

Many mounting interfaces have been employed in the prior art solve these problems. As one example, U.S. Pat. No. 6,675,694 to Liebig discloses a mounting apparatus specifically suited to a weapon that does not have a forward mount point such as an MK 46 machine gun. This mount secures to the weapon utilizing the ammunition can thereof as an attachment point, and supplies a main coupling that can be attached to an existing tripod or other vehicle mount.

Additionally, U.S. Pat. No. 4,417,499 to Grosser et al. provides a mounting apparatus for a weapon that permits its azimuth and elevation to be adjustable by providing trunnion arms at an upper end that engage the weapon trunnions.

However, most of these prior art systems are fairly complex, both in operation and in their manufacture, and as a result they are prone to failure under demanding operating conditions. Furthermore, many of these systems are unique to a specific weapon. In the art, there are several types of weapons that may utilize similar or identical mounting systems, where the weapons themselves are configured for such mounting. As one example, the M249 light machine gun, the M240 medium machine gun, and the MAG 58 machine gun, a variant of the M240, all may utilize a similar mount to securely fasten these weapons to a platform.

Many prior art mounting systems provide weapons attachment apparatus manufactured from aluminum sheet that are subsequently bent or otherwise shaped into a suitable configuration for engaging a weapon. However, in many of these systems the mating points with the weapon are not consistently placed, thereby leading to some mounts that don't readily accept or positively secure the weapon on the mount. Furthermore, many prior art systems include a multiplicity of parts that require operator adjustment and that may be broken or misplaced. Even in prior art cradle systems employing single piece construction, often it is necessary or desirable to secure an ammunition can to the mount. These prior art devices are typically quite prone to bending and twisting due the weight of the ammunition can and the stress put on the cradle thereby as the platform is subjected to various transport stresses.

Accordingly, there is a need for a lightweight yet extremely durable cradle type mounting system that can quickly accept and positively secure a plurality of weapons to a platform with a minimum of parts and ease of manufacture.

SUMMARY OF THE INVENTION

The present invention provides an apparatus and system for securing a weapon having a plurality of contact points to a platform for quick and easy use. The invention includes a cradle that comprises a pair of spaced front flanges and a pair of spaced rear flanges. Front and rear flanges are connected by a pair of spaced side portions to form a single piece cradle. The cradle may be manufactured from a single piece of high-strength material such as aluminum or stainless steel by machining the proper cradle shape into the material. This feature of the invention provides for a plurality of weapon contact points that remain consistent in their positions relative to the weapon components over time and under difficult conditions and repeated use.

The cradle includes a pair of opposed retaining pin apertures in the front flanges and rear flanges respectively. Front and rear flanges are spaced longitudinally and laterally from each other to enable a weapon, for example an M249 machine gun, the be placed therebetween and secured to the cradle by placing retaining pins, for example ball-lock pins, through the pin apertures.

In one embodiment of the invention, the cradle and its concomitant front and rear inserts are machined from a single piece of aluminum having one side comprising material having a significantly enhanced thickness. This embodiment of the invention provides for a plurality of weapon contact points that remain consistent in their positions relative to the weapon components over time and under rugged conditions as encountered in the field, as well as an enhanced strength portion of the cradle capable of supporting the weight of an ammunition can mounted thereto.

The cradle of the present invention further comprises a pair of spaced pintle flanges each having a retaining pin aperture therein for accepting a retaining pin. A pintle having a pin aperture therethrough is positioned between the spaced pintle flanges and a retaining pin is inserted through both the retaining pin apertures in the flanges and the pintle pin aperture to rotatably secure the cradle to the pintle. The cradle is then rotatable, through a limited range of motion, around the retaining pin such that a weapon secured therein may be rotated vertically for aiming purposes.

The system and apparatus of the present invention further includes a side portion having a plurality of ammunition can holders secured thereto to accept a plurality of differing types of commonly used ammunition cans to accommodate a plurality of weapons. In one embodiment of the invention, the side of the cradle to which the ammunition can holders are secured has an enhanced thickness to resist twisting cause by the weight of a full ammunition can secured thereto.

Other objects, features and advantages of the instant invention will become apparent from the detailed description of the preferred embodiments included herein below, taken in conjunction with the drawing Figures wherein:

BRIEF DESCRIPTION OF THE DRAWING FIGURES

DETAILED DESCRIPTION OF THE PREFERRED EMBODIMENT(S)

Figure 1:
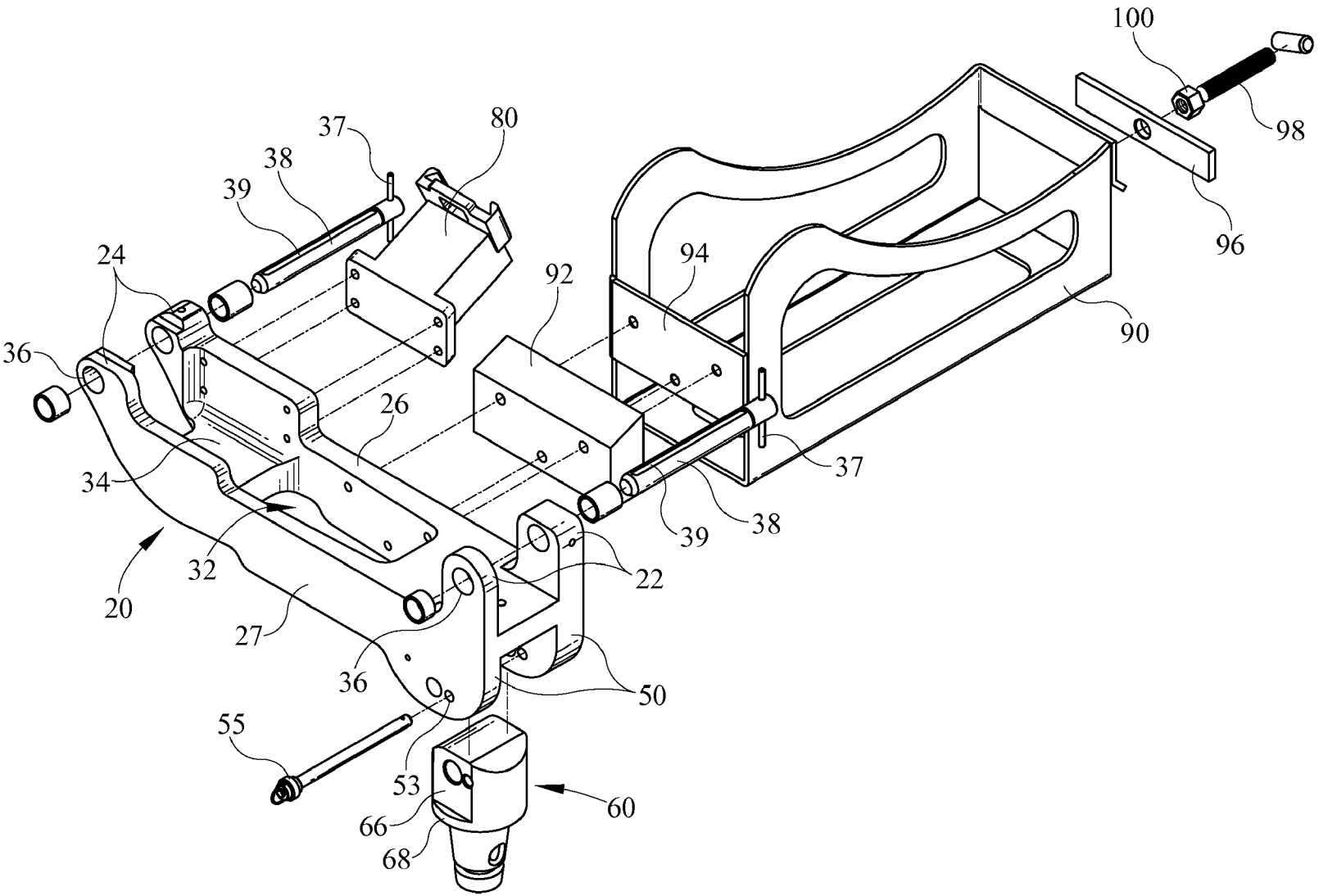
FIG. 1 is an exploded perspective view of a cradle assembly in accordance with one embodiment of the present invention.
Figure 2:
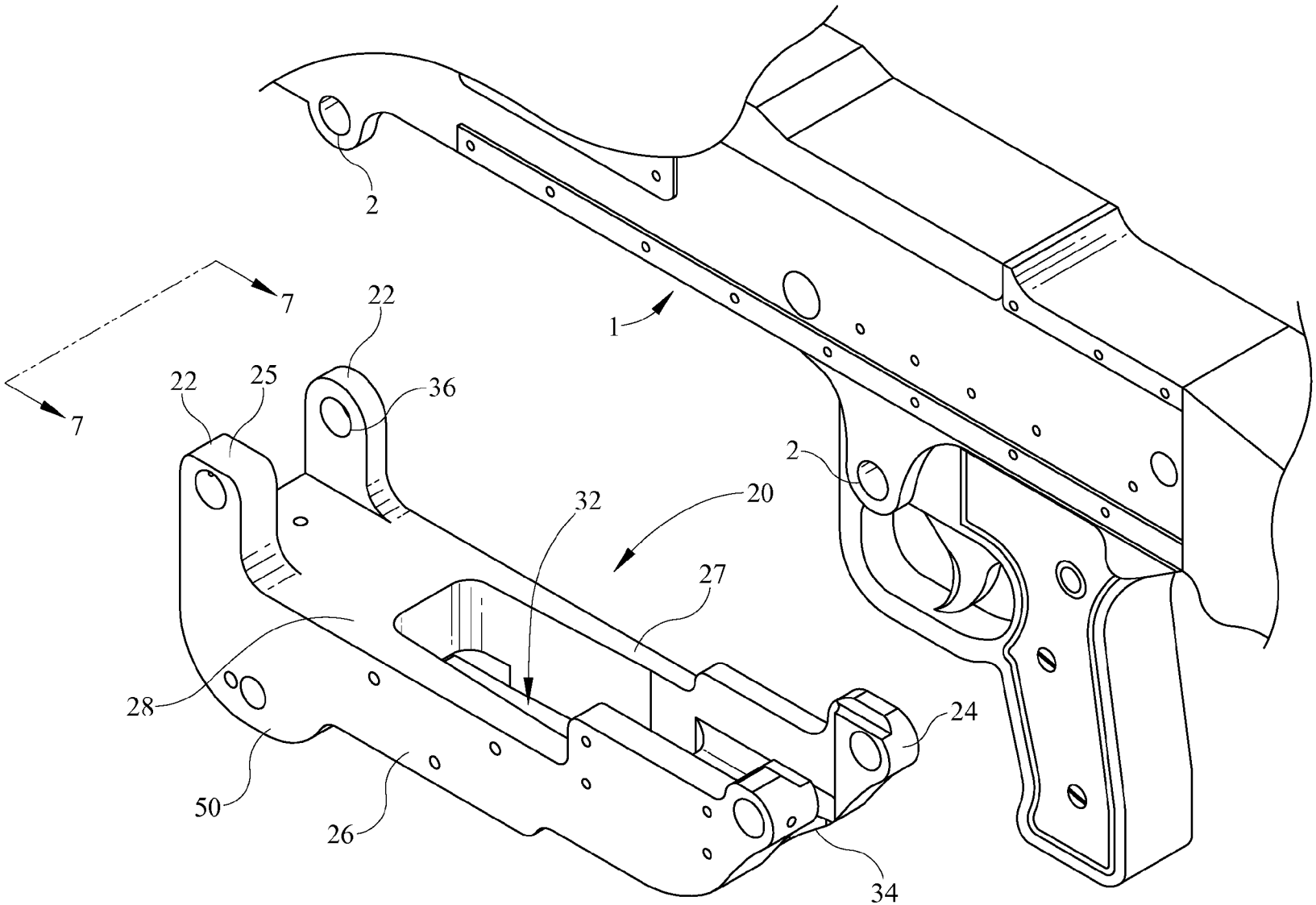
FIG. 2 is a perspective view of a cradle in accordance with one embodiment of the present invention.

Referring now to FIGS. 1 and 2, and in accordance with a preferred constructed embodiment of the present invention, a weapon mounting system 10 for securing a weapon 1 such as a machine gun to a platform includes a cradle 20 having a front and rear opposed flanges 22 and 24 respectively for supporting weapon 1 in a usable position. While the present system 10 may be adapted for use with a wide variety of weapons 1 the exemplary embodiments included herein refer primarily to a machine gun type weapon including but not limited to an M249 light machine gun, M240 medium machine gun, and MAG58 machine gun that are engaged by cradle 20 when weapon 1 is properly secured thereto.

Cradle 20 may comprise a pair of opposed first and second side portions, 26 and 27 respectively, that terminate at a rear end in rear flange 24 and terminate at a front end in front flange 22. Side portions 26, 27 are arranged generally in the same vertical plane as front 22 and rear 24 flanges, thus providing sides 26, 27 that are integral with front 22 and rear 24 flanges, thereby enhancing structural rigidity for cradle 20. Additionally, cradle 20 may comprise a central body 28 that connects side portions 26, 27 and front flanges 22, further enhancing structural rigidity of cradle 20.

As seen in FIGS. 1 and 2, cradle 20 may further comprise a slot or orifice 32 through which spent shell casings of a weapon 1 are ejected when secured to cradle 20. This feature of the invention is necessary for weapons 1 having ejection mechanisms that eject shell casings from the bottom of the weapon's receiver. Slot 32 may comprise a variety of differing shapes to accommodate various types of weapons 1 without departing from the scope of the present invention. Furthermore, rear flanges 24 may be connected together by a rear portion 34 of cradle 20 to further strengthen rear flanges 24 and support weapon 1.

Front flanges 22 and rear flanges 24 each include a retaining pin aperture 36 therein, positioned in flanges 22 and 24 such that a retaining pin 38 may be inserted through an aperture 36 on a first side 26, then through a retaining pin aperture 2 of weapon 1, and finally through an aperture 36 on a second side 27, thereby securing weapon 1 to cradle 20 at two contact locations. Front flanges 22 and rear flanges 24 may be spaced from each other horizontally and vertically positioned to accommodate a wide variety of weapons 1, in accordance with one embodiment of the present invention.

Figure 9:
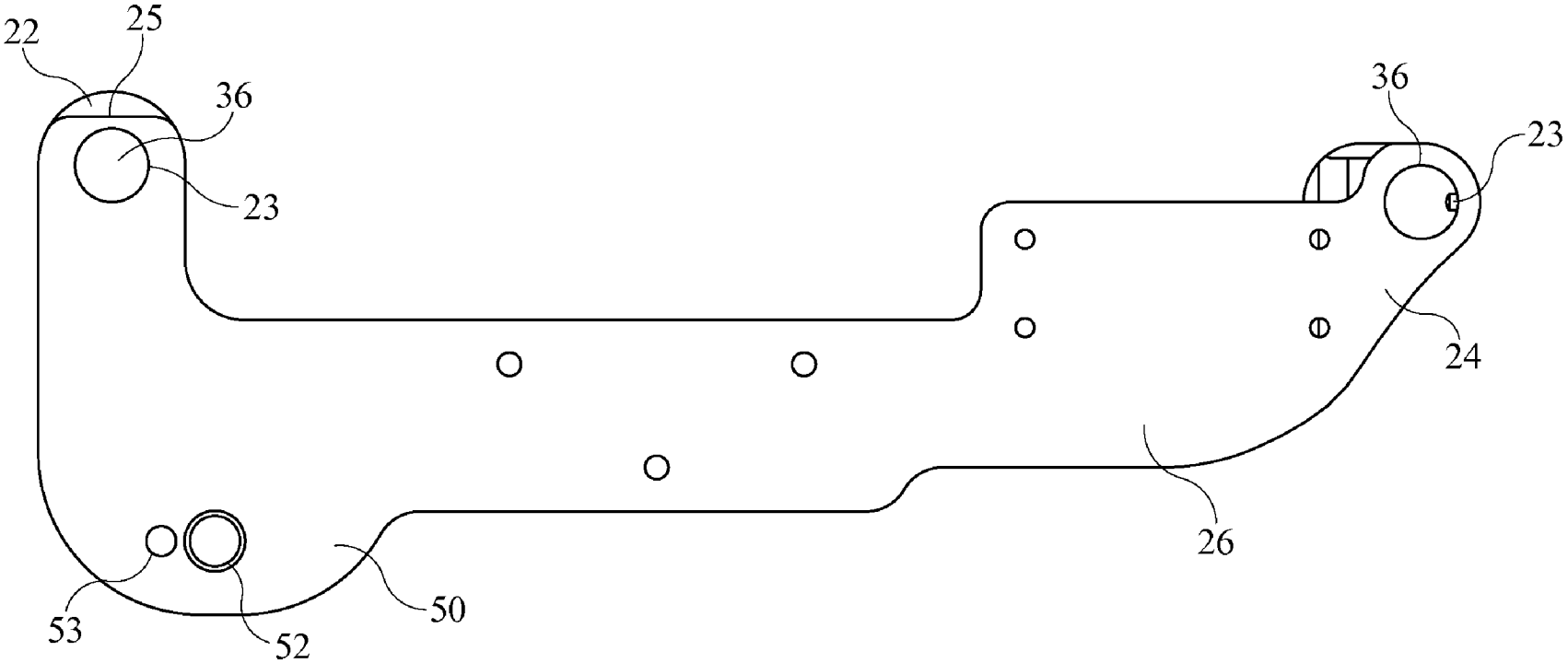
FIG. 9 is a side elevation view of a cradle in accordance with one embodiment of the invention.

Furthermore, front flanges 22 and 24 may include an indexing pin 23, depicted in FIG. 9, extending inwardly into apertures 36 to engage a retaining pin 38 having an axial index track 39 or groove therein. Furthermore, retaining pins 38 may comprise T-handles 37 that facilitate pin insertion and removal. In this embodiment of the invention, the indexing pins 23 require that the axial track 39 in retaining pin 38 engage the indexing pins 23 in order for retaining pins 38 to be inserted in apertures 36. This feature of the invention allows proper positioning of index pins 23 such that the T-handles 37 are oriented upon insertion of pins 38 into apertures 36 so that they do not interfere with various components of a weapon 1 being mounted in cradle 20. This feature of the invention is a significant improvement over the prior art, since rapid weapon 1 mounting and removal is often crucial, and access to properly oriented retaining pins 38 is critical to the task.

In a further embodiment of the invention, retaining pins 38 may comprise stainless steel T-handle 37 ball locking pins with an axial recessed indexing track 39 to enable positive locking of pins 38 in apertures 36. Additionally, stainless steel aperture bushings 40 may be inserted within apertures 36 to provide for longer life and greater wear at the attachment points of weapon 1. Where in the embodiment of the invention wherein stainless bushings 40 are employed, indexing pins 23 may extend inwardly into aperture 38 from bushings 40. Many weapons include stainless mounting bores and lugs for accepting T-handle pins 38. The use of stainless steel aperture bushings 40 and stainless steel T-handle locking pins 38 provides for positive mating of weapon 1 and cradle 20 since all mating surfaces are comprised of the same material.

Figure 7:
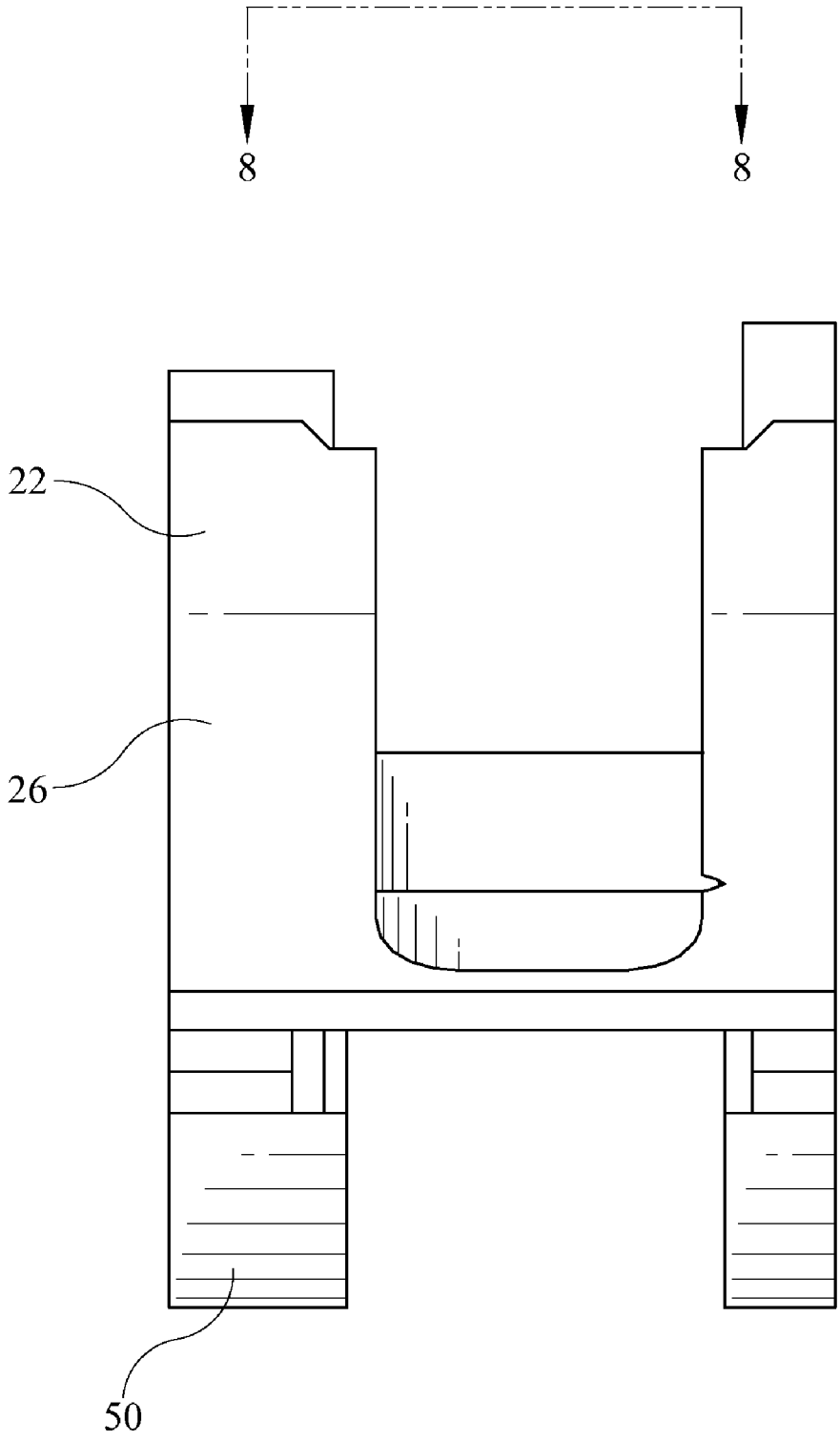
FIG. 7 is a front elevation view of a cradle taken along the line 7-7 of FIG. 2 in accordance with one embodiment of the present invention.
Figure 8:
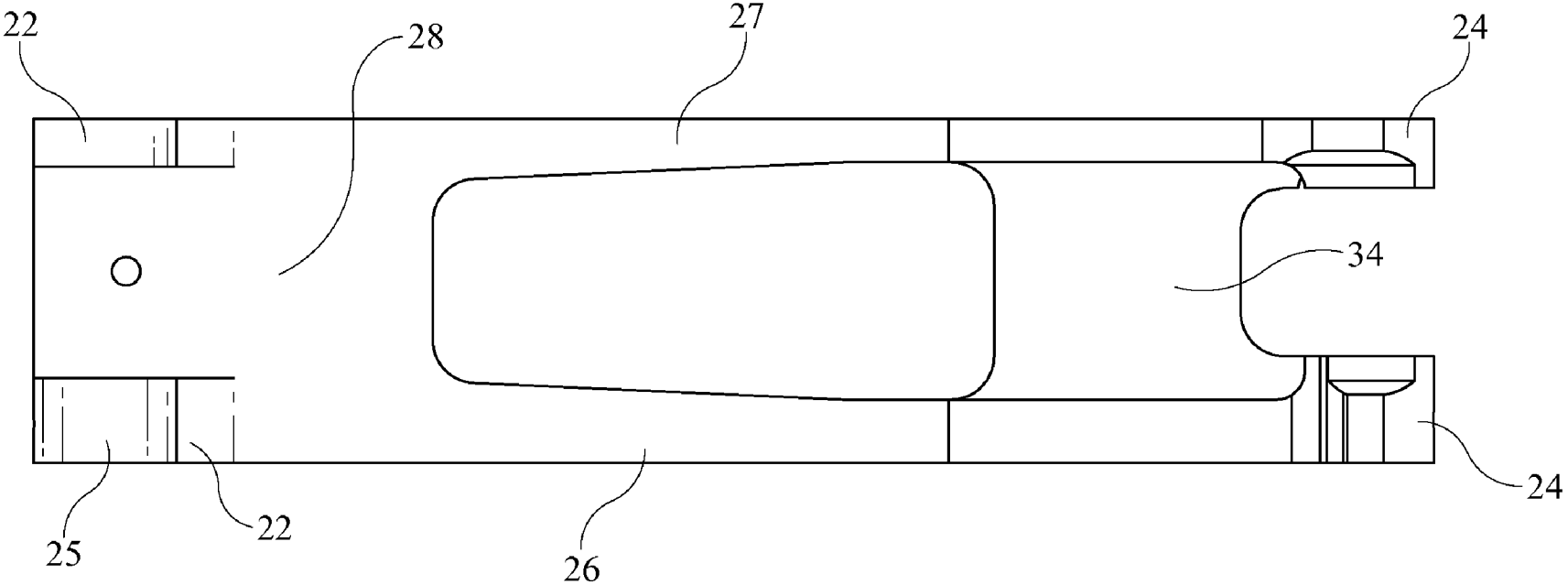
FIG. 8 is a top plan view of a cradle taken along the line 8-8 of FIG. 7 in accordance with one embodiment of the present invention.

Referring again to FIG. 1 and also to FIGS. 7, 8 and 9, cradle 20 further comprises a pair of spaced pintle flanges 50 extending generally downwardly from front flanges 22. Each pintle flange 50 includes a retaining pin aperture 52 therethrough to accept a retaining pin 38, thus enabling cradle 20 to be secured to a pintle 60, best seen in FIGS. 3-5. Pintle flanges 50 are located such that cradle 20 rotates vertically around pintle retaining pin 38 when cradle 20 is secured to pintle 60. Additionally, pintle flanges 50 may comprise a locking pin aperture 53 that permits cradle 20 to be locked in place with respect to pintle 60, as discussed further below.

Figure 3:
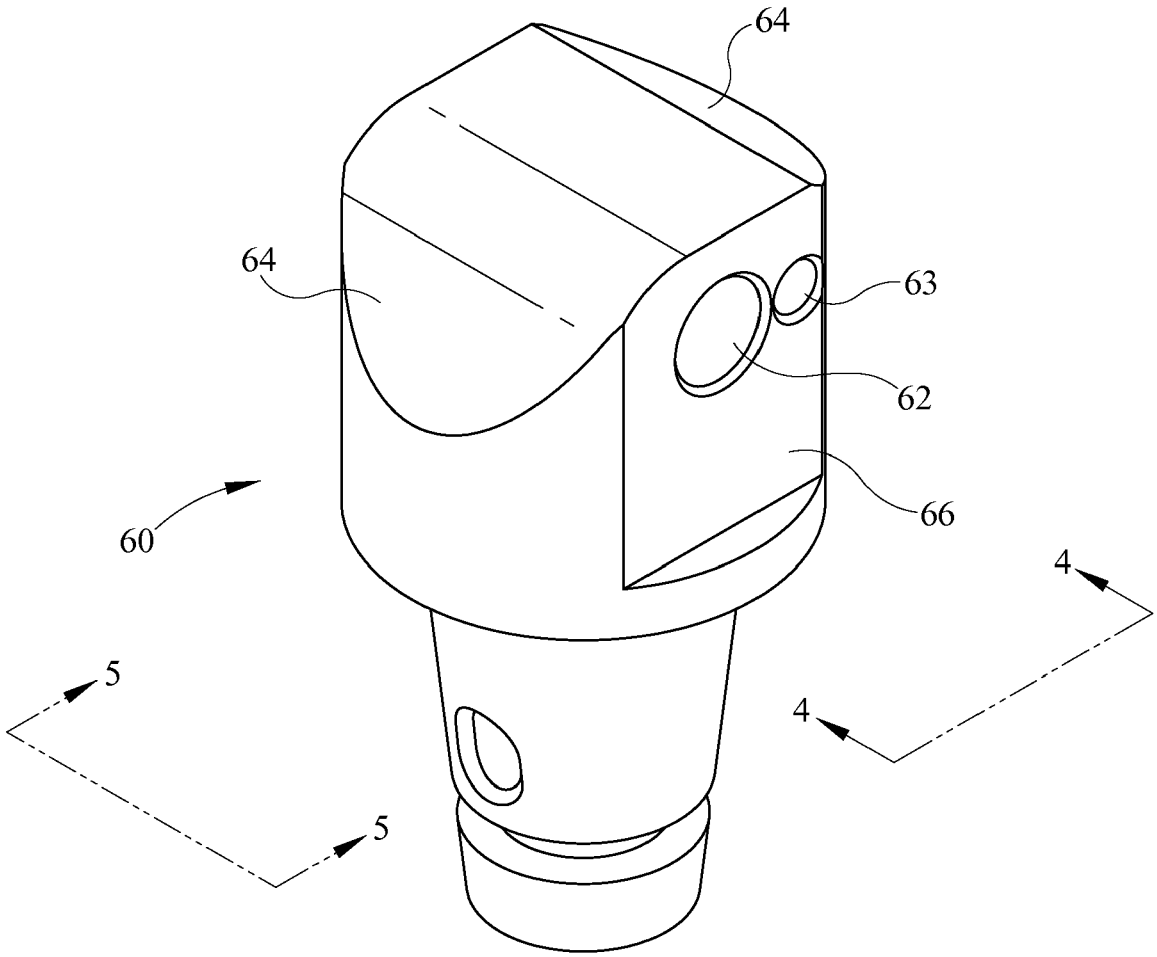
FIG. 3 is an isometric view of a pintle in accordance with one embodiment of the present invention.
Figure 4:
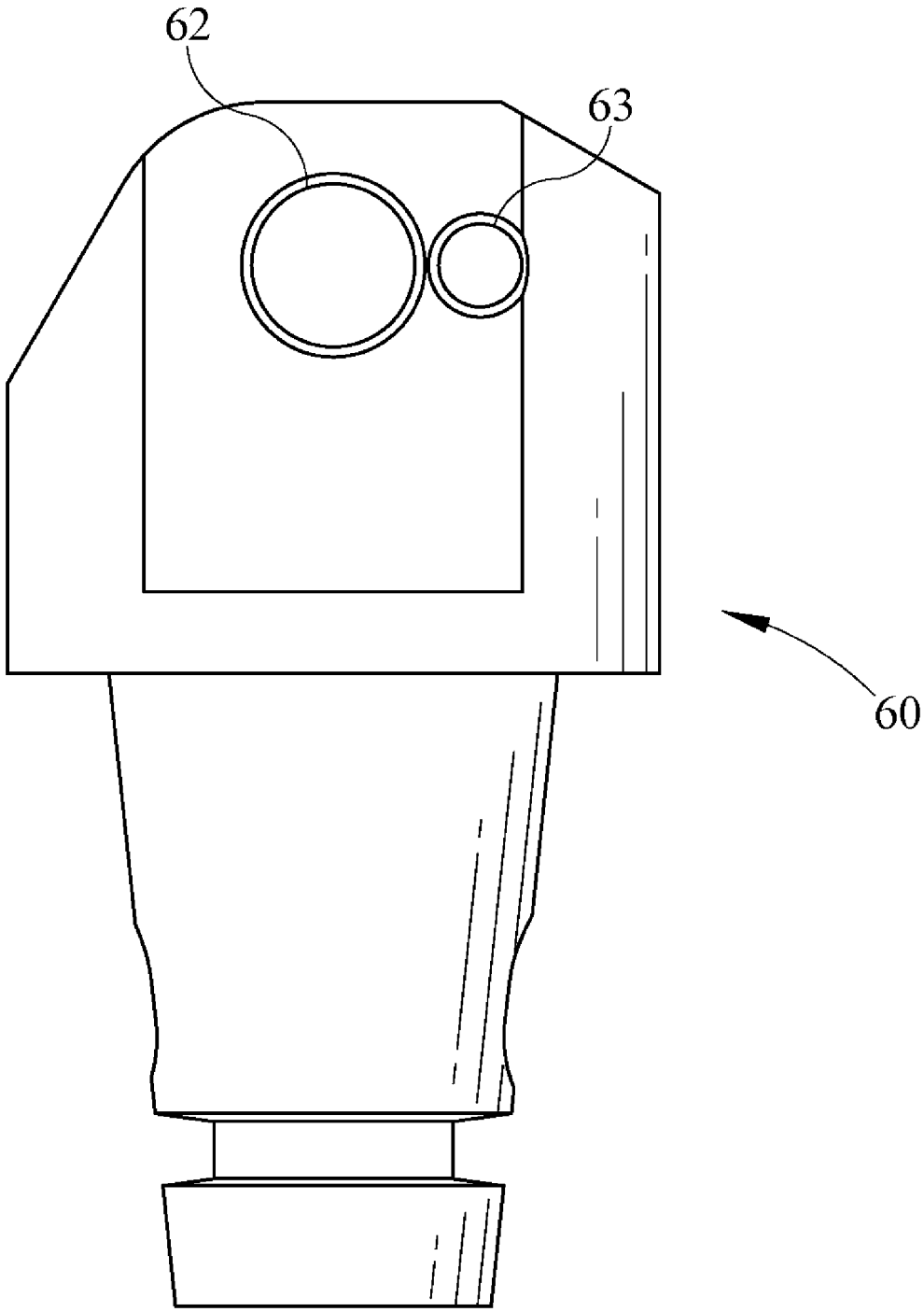
FIG. 4 is a view of a pintle taken along the line 4-4 of FIG. 3 in accordance with one embodiment of the present invention.
Figure 5:
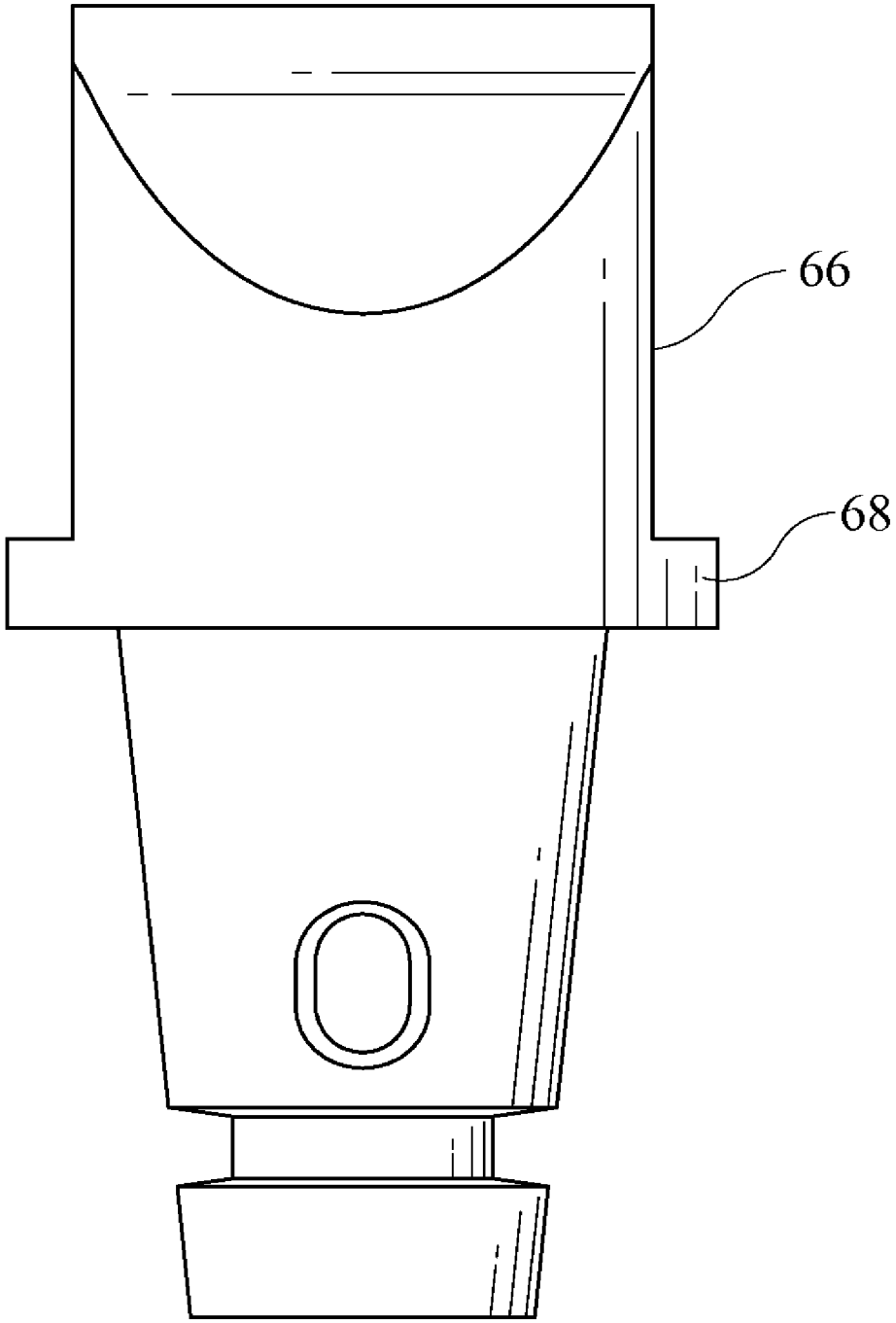
FIG. 5 is a view of a pintle taken along the line 5-5 of FIG. 3 in accordance with one embodiment of the present invention.

Pintle 60 comprises a first central bore 62 extending horizontally therethrough for accepting pintle retaining pin 38 and securing pintle 60 to pintle flanges 50 as retaining pin 38 is inserted through one aperture 52, through central bore 62, and then through second aperture 52. As best seen in FIGS. 1, 3 and 4, pintle 60 may further comprise a locking bore 63 extending therethrough, that accepts a locking pin 55 as it is inserted through flange 50 locking pin aperture 53. When in place, locking pin 55 prohibits any vertical rotation of cradle 20, and thus weapon 1, around the central bore 62 of pintle 60, thereby securing weapon 1 in place for travel or cleaning.

Pintle 60 further includes a pair of beveled surfaces 64 at front and rear portions of pintle 60 to enable rotation of cradle 20 about an axis defined by pintle retaining pin 38. Beveled surfaces 64 allow cradle 20 to rotate through a predetermined range of motion without coming into contact with pintle 60.

Additionally, pintle 60 comprises a pair of recessed side portions 66 that are shaped to accommodate pintle flanges 50. This feature of the invention permits pintle 60 recessed side portions 66 to engage pintle flanges 50 tightly, thereby enabling cradle 20 to be tightly secured to pintle 60. Recessed side portions 66 terminate in a pair of horizontal stop flanges 68 which are positioned to make contact with pintle flanges 50 at a predetermined point to prevent further rotation of cradle 20 past a certain vertical orientation. Thus by changing the angle of stop flanges 68 with respect to a horizontal plane, pintle 60 may be produced to permit varying ranges of rotation of cradle 20 around pintle retaining pin 54.

Referring again to FIGS. 1 and 2, cradle 20 may further comprise a small ammunition can mount 80, which is preferably machined from a single piece of material and is designed to accommodate a clip-on type ammunition can. In one embodiment of the present invention, can mount 80 is configured to accept a conventional SAW (squad automatic weapon) ammunition drum. Small ammunition can mount 80 is secured to a first side 26 of cradle 20 with a plurality of conventional fasteners such as screws or bolts.

Figure 6:
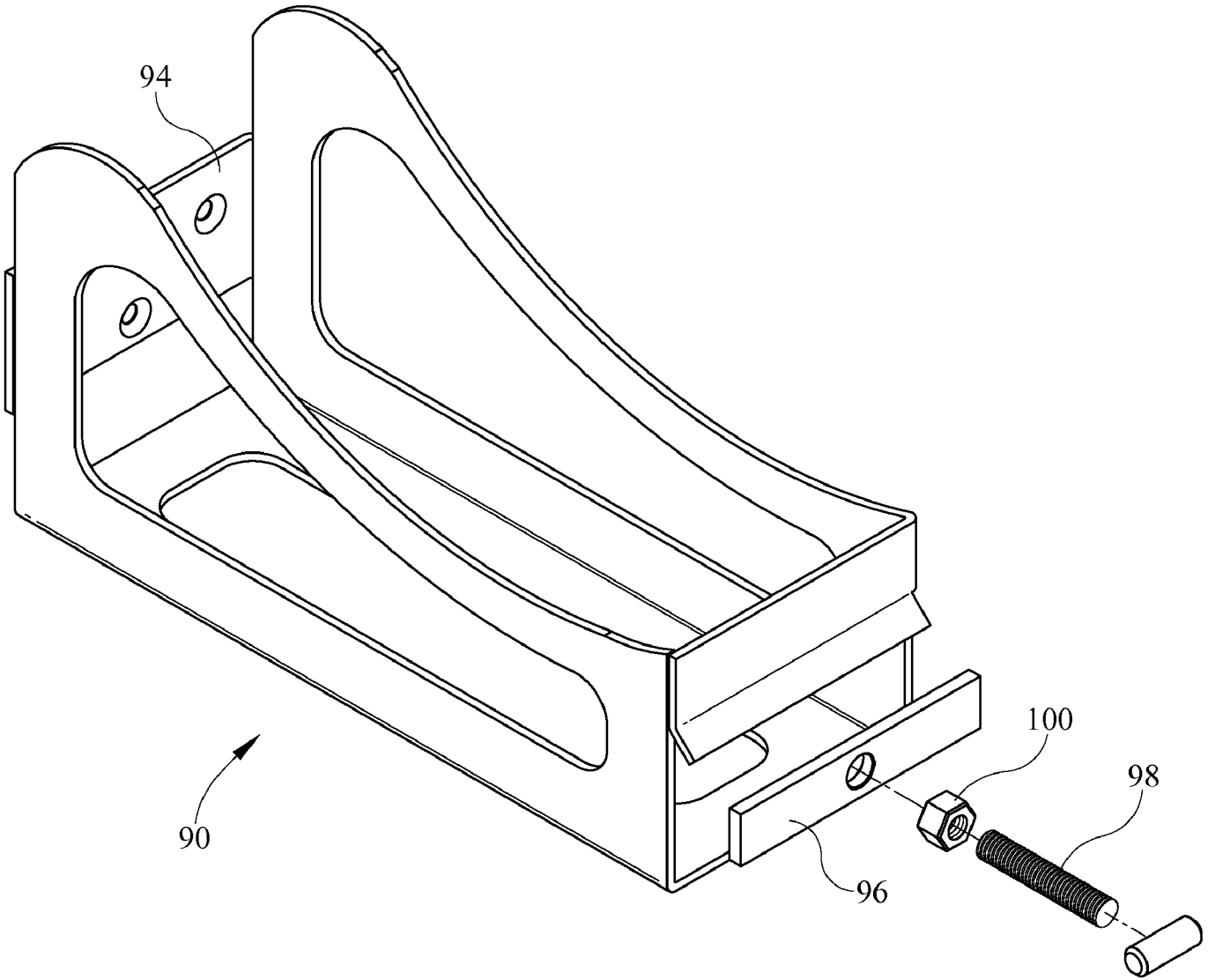
FIG. 6 is an isometric view of a large ammunition can holder in accordance with one embodiment of the present invention.

As best seen in FIGS. 1 and 6, cradle 20 may further comprise a large ammunition can mount 90, which is secured to side 26 of cradle 20 by fastening a billet 92 to side 26 with a plurality of conventional fasteners, then securing a front wall 94 of large ammunition can mount 90 to billet 92. Billet 92 is shaped to space large ammunition can mount 90 both outwardly and upwardly from cradle 20, to position an ammunition can secured in mount 90 in an optimal position to feed ammunition into weapon 1. Billet 92 can comprise different sized so that ammunition exiting the top of an ammunition can feeds into the receiver of weapon 1 at a generally horizontal orientation. This feature of the invention enables ammunition to feed smoothly into weapon 1 which avoids jamming. Additionally, the use of billet 92 adds structural rigidity to first side 26 to accommodate the load thereon when a full ammunition can is inserted in mount 90. Accordingly, billet 92 may be sized such that mount 90 is positioned vertically and horizontally away from cradle 20 to optimize ammunition feed for a specified weapon 1.

Large mount 90 is additionally comprised of a rear strut 96 through which a threaded T-handle 98 may be inserted. Additionally, T-handle 98 may first be threaded through a bolt 100 to provide a locking mechanism for T-handle 98. Once an ammunition can is placed in mount 90, T-handle 98 is simply screwed into rear strut 96 until it firmly contacts the ammunition can, thereby holding it in place. Additionally, in one embodiment of the invention large mount 90 is machined from stainless steel to increase its resistance to wear and bending during use.

In a yet further embodiment of the invention as best seen in FIGS. 7 and 8, front flange 22, rear flange 24 and pintle flange 50 located on first side 26, and first side 26 are sized to a thickness that is substantially greater than that of the opposed front flange 22, rear flange 24, pintle flange 50 and second side 27. In one embodiment of the invention where cradle 20 is comprised of high strength aluminum, front flange 22, rear flange 24, pintle flange 50, and first side 26 are between 50%-100% greater in width than the same components located on second side 27 of cradle 20. These enhanced thickness components provide enhanced structural rigidity to cradle 20 on first side 26, which resists the bending and twisting that occurs when ammunition cans are secured to first side 26, either using small mount 80 or large mount 90.

Front flange 22 located no first side 26 of cradle 20 may further comprise a flattened upper portion 25 proximate the retaining pin aperture 36. The flattened upper portion permits a barrel removal mechanism common to a plurality of weapons to be accessed and manipulated without removing weapon 1 from cradle 20 in the event that a barrel change becomes necessary during use.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A cradle for rotatably securing a weapon to a platform comprising:

a single piece cradle having a pair of opposed front flanges and a pair of opposed rear flanges for engaging front and rear contact points of said weapon;

a first side connecting a front flange and a rear flange said rear flange extending upwardly from said first side;

a second side connecting a front flange and a rear flange said rear flange extending upwardly from said second side, said first and second sides being generally opposed; and wherein said first side, said front flange, and said rear flange connected thereby each have a thickness greater than the thickness of said second side, said front flange and said rear flange connected thereto.

2. A cradle for rotatably securing a weapon to a platform as claimed in claim 1 comprising:

a single piece ammunition can holder secured to said first side of said cradle.

3. A cradle for rotatably securing a weapon to a platform as claimed in claim 1 comprising:

a pair of opposed pintle flanges extending generally downwardly from said cradle for engaging a pintle.

4. A cradle for rotatably securing a weapon to a platform as claimed in claim 3 comprising:

a first pair of opposed pintle apertures in said pintle flanges for accepting a pintle retaining pin therethrough.

5. A cradle for rotatably securing a weapon to a platform as claimed in claim 4 comprising:

a second pair of opposed pintle apertures in said pintle flanges, offset from said first pair of opposed pintle apertures, for accepting a pintle locking pin therethrough.

6. A cradle for rotatably securing a weapon to a platform as claimed in claim 5 comprising:

a pintle having a locking pin aperture therethrough for accepting a locking pin.

7. A cradle for rotatably securing a weapon to a platform as claimed in claim 3 comprising:

a pintle having a lower portion for engaging a weapon platform and having a pair of recessed side portions for engaging said pintle flanges.

8. A cradle for rotatably securing a weapon to a platform as claimed in claim 7 comprising:

a pintle having a retaining pin aperture therethough for accepting a retaining pin to secure said pintle to said cradle.

9. A cradle for rotatably securing a weapon to a platform as claimed in claim 1 comprising:

a billet secured to said first side of said cradle and an ammunition can holder secured to said billet.

10. A cradle for rotatably securing a weapon to a platform as claimed in claim 9 wherein said billet positions said ammunition can holder to facilitate ammunition feed to said weapon.

11. A cradle for rotatably securing a weapon to a platform as claimed in claim 1 comprising:

a pair of opposed retaining pin apertures in said opposed front flanges and in said opposed rear flanges for accepting retaining pins therethrough.

12. A cradle for rotatably securing a weapon to a platform as claimed in claim 11 comprising:

a plurality of stainless steel annular bushing inserts disposed in each of said opposed retaining pin apertures.

13. A cradle for rotatably securing a weapon to a platform as claimed in claim 1 comprising:

a central portion having an orifice therein between said first and said second sides to provide egress for spent ammunition casings.

14. A cradle for rotatably securing a weapon to a platform comprising:

a unitary cradle body having front and rear opposed flanges for engaging contact apertures of said weapon, said front and rear flanges on a first side of said cradle body having a greater thickness than said front and rear flanges on a second side of said cradle body, said cradle body having a central portion having an orifice therein for egress of ejected shell casings, said cradle body further having a pair of opposed pintle flanges for engaging a pintle.

15. A cradle for rotatably securing a weapon to a platform as claimed in claim 14 further comprising:

a pintle having a pair of recessed side portions for engaging said pintle flanges and a stop flange for contacting said pintle flanges, thereby prohibiting vertical rotation of said cradle body past a predetermined point.

16. A cradle for rotatably securing a weapon to a platform as claimed in claim 15 comprising:

said pair of opposed pintle flanges having opposed apertures therein and said pintle having a central port therein whereby a retaining pin engages said opposed apertures and said central port to secure said weapon to said pintle and to permit rotation of said cradle around said retaining pin.

17. A cradle for rotatably securing a weapon to a platform as claimed in claim 14 comprising:

said cradle body having a first side with an enhanced width, said first side connected to a one of said front flanges and a one of said rear flanges.

18. A cradle for rotatably securing a weapon to a platform as claimed in claim 17 comprising:

a billet secured to said first side of said cradle and an ammunition can mount secured to said billet, whereby said billet is positioned to provide substantially horizontal ammunition feed to said weapon.

19. A cradle for rotatably securing a weapon to a platform as claimed in claim 18 wherein said ammunition can mount comprises a stainless steel alloy.

20. A cradle for rotatably securing a weapon to a platform comprising:

a cradle body having a pair of spaced forward bores and a pair of spaced rear bores therein connected by first and second spaced sides between said forward and rear bores, said first side and said forward and rear bore connected to said first side having a thickness greater than that of said second side;

said spaced forward bores being aligned with a forward weapon lug whereby a retaining pin engages each of said forward bores and said forward weapon lug; and said spaced rear bores being aligned with a rear weapon lug whereby a retaining pin engages each of said rear bores and rear weapon lug.

21. A cradle for rotatably securing a weapon to a platform as claimed in claim 20 comprising:

said forward bore and said rear bore located on a first side of said cradle having an axial length that is at least fifty percent greater than the axial length of said forward and rear bores on a second side of said cradle.

22. A cradle for rotatably securing a weapon to a platform as claimed in claim 21 comprising:

a plurality of stainless steel annular bore inserts disposed in each of said opposed forward and rear bores.

23. A cradle for rotatably securing a weapon to a platform as claimed in claim 21 comprising:

a pair of opposed first and second pintle flanges, each having a pintle bore therein, said first pintle bore having a length that is at least fifty percent greater than the length of said second pintle bore.

24. A cradle for rotatably securing a weapon to a platform as claimed in claim 23 comprising:

a pintle having a central bore therein, and having recessed side portions for engaging said opposed first and second pintle flanges, whereby a retaining pin is inserted through said pintle flange bores and said pintle bore to rotatably secure said cradle to said pintle.

* * * * *